US011097293B2

(12) United States Patent
Wu et al.

(10) Patent No.: US 11,097,293 B2
(45) Date of Patent: Aug. 24, 2021

(54) WATER OUTLET DEVICE

(71) Applicant: Xiamen Solex High-Tech Industries Co., Ltd., Xiamen (CN)

(72) Inventors: Shilong Wu, Xiamen (CN); Wenxing Chen, Xiamen (CN); Fengde Lin, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 163 days.

(21) Appl. No.: 16/601,805

(22) Filed: Oct. 15, 2019

(65) Prior Publication Data

US 2020/0114374 A1 Apr. 16, 2020

(30) Foreign Application Priority Data

Oct. 15, 2018 (CN) ..... 201811195571.X

(51) Int. Cl.
*B05B 3/04* (2006.01)
*B05B 1/34* (2006.01)

(52) U.S. Cl.
CPC ..... *B05B 3/0422* (2013.01); *B05B 1/3426* (2013.01); *B05B 1/3468* (2013.01); *B05B 3/0468* (2013.01)

(58) Field of Classification Search
CPC ... B05B 3/0422; B05B 3/0468; B05B 1/3426; B05B 1/3468
USPC ..... 239/240, 380–383, 390, 396, 499, 504, 239/548
See application file for complete search history.

(56) References Cited

U.S. PATENT DOCUMENTS 3,547,352 A * 12/1970 Hadsel ..... B05B 3/0486 239/383
6,223,998 B1 * 5/2001 Heitzman ..... B05B 3/04 239/383
6,360,967 B1 * 3/2002 Schorn ..... B05B 1/14 239/381
6,896,201 B1 * 5/2005 Ouyoung ..... B05B 1/14 239/548
7,946,512 B2 * 5/2011 Schorn ..... B05B 3/0422 239/383
2014/0077005 A1 * 3/2014 Chen ..... B05B 1/18 239/548
2016/0184841 A1 * 6/2016 Lin ..... B05B 1/1636 239/240

* cited by examiner

*Primary Examiner* — Steven J Ganey
(74) *Attorney, Agent, or Firm* — Cooper Legal Group, LLC

(57) ABSTRACT

The present invention discloses a water outlet device, comprising: at least one rotatable driving member, at least one injector, and a main body with a plurality of water outflow passages. The main body comprises at least one accommodating cavity, each of the at least one rotatable driving member is driven to rotate by water flow, and each of the at least one rotatable driving member drives the corresponding one of the at least one injector to rotate in the corresponding one of the at least one accommodating cavity. Each of the at least one injector comprises at least one injection hole, the at least one injection hole is connected to the corresponding one of the plurality of water outflow passages, and a water outflow direction of the at least one injection hole and an axial direction of the corresponding one of the plurality of water outflow passage forms an angle.

14 Claims, 13 Drawing Sheets

A-A

WATER OUTLET DEVICE

RELATED APPLICATIONS

This application claims priority to Chinese Patent Application 201811195571.x, filed on Oct. 15, 2018, which is incorporated herein by reference.

FIELD OF THE DISCLOSURE

The present invention relates to the field of bathroom fixtures, in particular the present invention relates to a water outlet device.

BACKGROUND OF THE DISCLOSURE

With respect to traditional showers or other water outlet devices, when water spray patterns need to be adjusted, an overall structure of the traditional showers or the water outlet devices needs to be redesigned, which provides poor structural versatility, and it is impossible to obtain a variety of water spray patterns only through a small structural adjustment to the traditional showers or the water outlet devices.

BRIEF SUMMARY OF THE DISCLOSURE

The present invention provides a water outlet device to solve the main technical problem of the existing techniques. Water spray patterns of the water outlet device can be changed by simple structural adjustment.

A water outlet device, comprising: at least one rotatable driving member, at least one injector, and a main body with a plurality of water outflow passages.

The main body comprises at least one accommodating cavity, each of the at least one accommodating cavity is connected to a corresponding one of the plurality of water outflow passages, each of the at least one accommodating cavity is disposed above the corresponding one of the plurality of water outflow passages, each of the at least one rotatable driving member and a corresponding one of the at least one injector are disposed in a corresponding one of the at least one accommodating cavity, each of the at least one rotatable driving member is driven to rotate by water flow, and each of the at least one rotatable driving member drives the corresponding one of the at least one injector to rotate in the corresponding one of the at least one accommodating cavity.

Each of the at least one injector comprises at least one injection hole, the at least one injection hole is connected to the corresponding one of the plurality of water outflow passages, and a water outflow direction of the at least one injection hole and an axial direction of the corresponding one of the plurality of water outflow passage forms an angle. A collision between water flowing out from the at least one injection hole and inner sidewalls of the corresponding one of the plurality of water outflow passages changes as a function of the angle.

The inner sidewalls of the plurality of water outflow passages are tapered.

In a preferred embodiment, in a cross-sectional view of each of the at least one injection hole in the axial direction of the corresponding one of the plurality of water outflow passages: a first sidewall of each of the at least one injection hole adjacent to a central axis of the injector is sloped relative to the axial direction of the corresponding one of the plurality of water outflow passages, and a second sidewall of each of the at least one injection hole away from the central axis of the injector is parallel to the axial direction of the corresponding one of the plurality of water outflow passages. Or, in the cross-sectional view of each of the at least one injection hole in the axial direction of the corresponding one of the plurality of water outflow passages: the first sidewall of each of the at least one injection hole adjacent to a central axis of the injector is sloped relative to the axial direction of the corresponding one of the plurality of water outflow passages, the second sidewall of each of the at least one injection hole away from the central axis of the injector also is sloped relative to the axial direction of the corresponding one of the plurality of water outflow passages, and a first angle between the second sidewall and the axial direction of the corresponding one of the plurality of water outflow passages is smaller than a second angle between the first sidewall and the axial direction of the corresponding one of the plurality of water outflow passages.

In a preferred embodiment, each of the at least one injector comprises at least two injection holes, at a surface of the at least one injector facing the corresponding one of the plurality of water outflow passages, a center of a first injection hole of the at least two injection holes is spaced a first distance from a central axis of the injector and a center of a second injection hole of the at least two injection holes is spaced a second distance from the central axis of the injector, and the second distance is greater than the first distance.

In a preferred embodiment, an angle between a water outflow direction of the first injection hole and the axial direction of the corresponding one of the plurality of water outflow passages is different than an angle between a water outflow direction of the second injection hole and the axial direction of the corresponding one of the plurality of water outflow passages.

In a preferred embodiment, a number of injection holes of the at least one injector having centers spaced the first distance from the central axis of the injector is different than a number of injection holes of the at least one injection having centers spaced the second distance from the central axis of the injector.

In a preferred embodiment, the angle between the water outflow direction of the first injection hole and the axial direction of the corresponding one of the plurality of water outflow passages is smaller than the angle between the water outflow direction of the second injection hole and the axial direction of the corresponding one of the plurality of water outflow passages.

In a preferred embodiment, a radial dimension of each of the inner sidewalls of the plurality of water outflow passages gradually becomes smaller in a direction of the water flow or the radial dimension of the each of the inner sidewalls of the plurality of water outflow passages gradually becomes larger in the direction of the water flow.

In a preferred embodiment, each of the inner sidewalls of the plurality of water outflow passages is disposed with a plurality of regulating strips, the plurality of regulating strips extend in the direction of the water flow, and the plurality of regulating strips are disposed along a circumference of each of the inner sidewalls at intervals.

In a preferred embodiment, the rotatable driving member is an impeller, the main body comprises at least one water oblique inlet on a first side away from the plurality of water outflow passages, and water flowing from the at least one water oblique inlet impacts the impeller and drives the impeller to rotate.

In a preferred embodiment, a first side of the impeller adjacent to the injector extends outwardly to form an insert bar in a direction of a central axis of the impeller, and the injector comprises an insert hole for coupling with the insert bar.

Compared with the existing techniques, the technical solution of the present invention has the following beneficial effects.

1. The present invention provides a water outlet device in which the inner sidewalls of the plurality of water outflow passages are tapered. When a radial dimension of each of the inner sidewalls of the plurality of water outflow passages gradually becomes smaller in a direction of the water flow, the water spray pattern of the water flow has a more concentrated range and a stronger impact force. When the radial dimension of each of the inner sidewalls of the plurality of water outflow passages gradually becomes larger in the direction of the water flow, the water spray pattern of the water flow has a larger range and a weaker impact force.

2. The present invention provides a water outlet device, each of the at least one injector comprises at least one injection hole, a water outflow direction of the at least one injection hole, and an axial direction of a corresponding one of the plurality of water outflow passages forms an angle a. As the angle a becomes larger, a collision between water flowing out from the at least one injection hole and inner sidewalls of the corresponding one of the plurality of water outflow passages becomes more obvious, an atomization effect of water spray pattern of the water flow becomes better, and an energy loss of the water flow becomes larger, so that an impact force of the water flow is decreased. When the angle a becomes smaller, the collision becomes less obvious, or water directly flows out without impacting the inner sidewalls, the atomization effect of the water spray pattern of the water flow becomes weaker, and an energy loss of the water flow becomes smaller, so that the impact force of the water flow is significantly enhanced.

3. The present invention provides a water outlet device, according to the aforementioned characteristics, in which a plurality of injection holes are defined by each of the at least one injector. At a surface of the at least one injector facing the corresponding one of the plurality of water outflow passages, centers of the plurality of injection holes can be arranged at different radial distances relative to a central axis of the at least one injector. When a larger impact force of the water is needed, a large number of the injection holes with a small angle can be disposed close to the central axis of the injector. When a larger outflow range is needed, a large number of injection holes with a large angle can be disposed further away from the central axis of the injector.

Therefore, the water outlet device provided by the present invention can freely adjust water spray patterns with various dispersed ranges, water outflow forms, and impact forces according to the adjustment of the angle a between the water outflow direction of the at least one injection hole and the axial direction of the corresponding one of the plurality of water outflow passages, an arrangement of the injection holes in a radial direction of the injector, and a taper β of the inner sidewalls of the plurality of water outflow passages, without making big adjustments to an overall structure of the water outlet device.

DETAILED DESCRIPTION OF THE EMBODIMENTS

Figure 1:
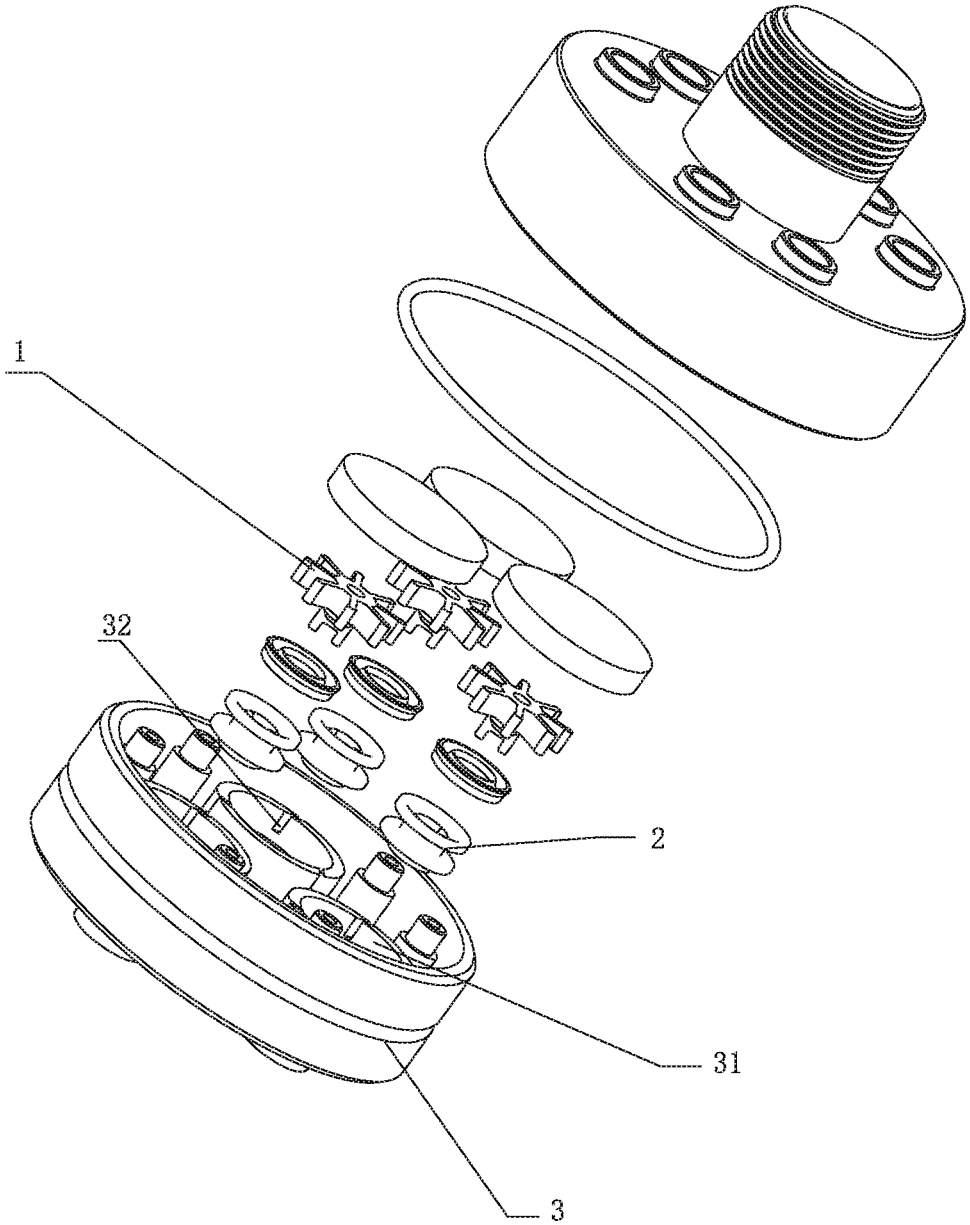
FIG. 1 illustrates an exploded view of Embodiment 1 of the present invention.
Figure 2:
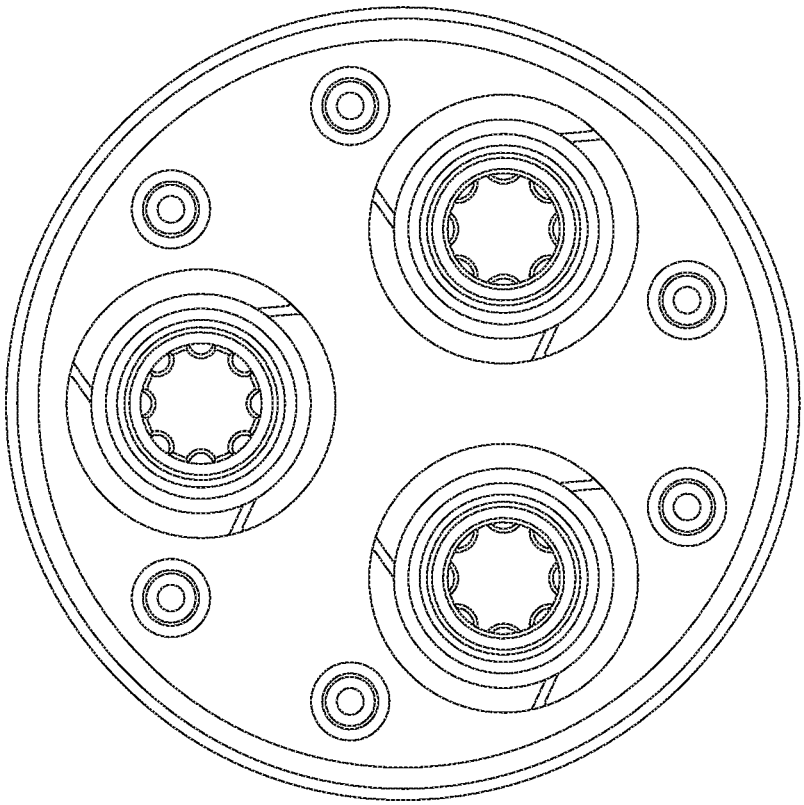
FIG. 2 illustrates a front view of the main body in Embodiment 1 of the present invention.
Figure 3:
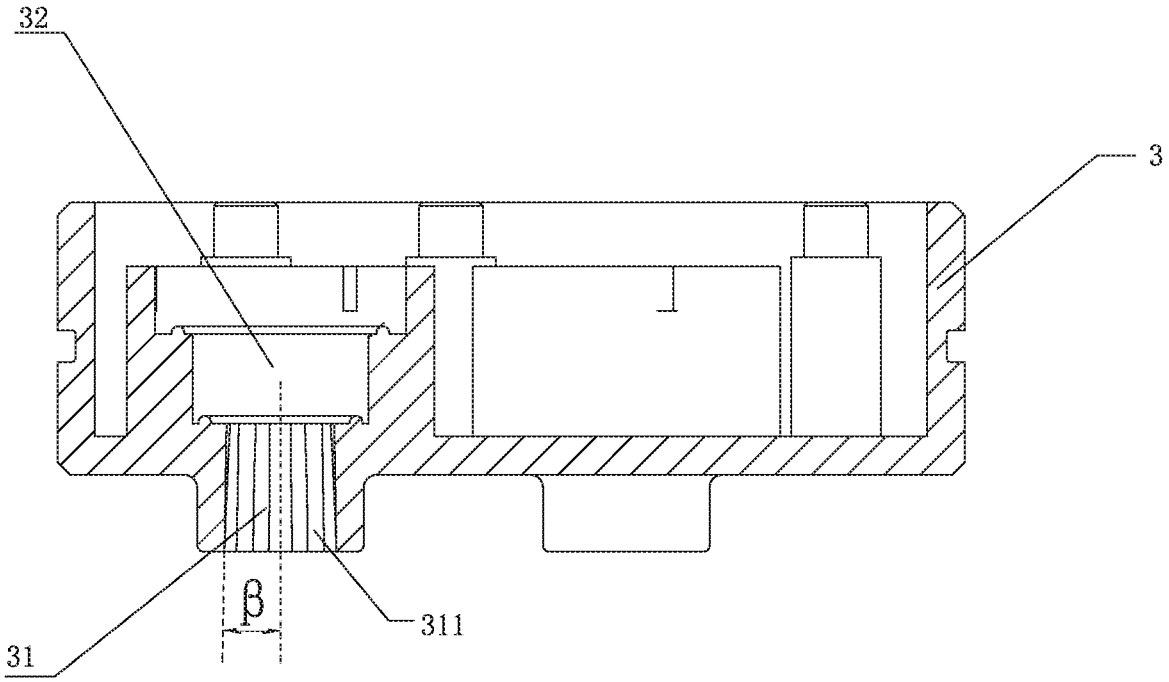
FIG. 3 illustrates a cross-sectional view of the main body in Embodiment 1 of the present invention.
Figure 4:
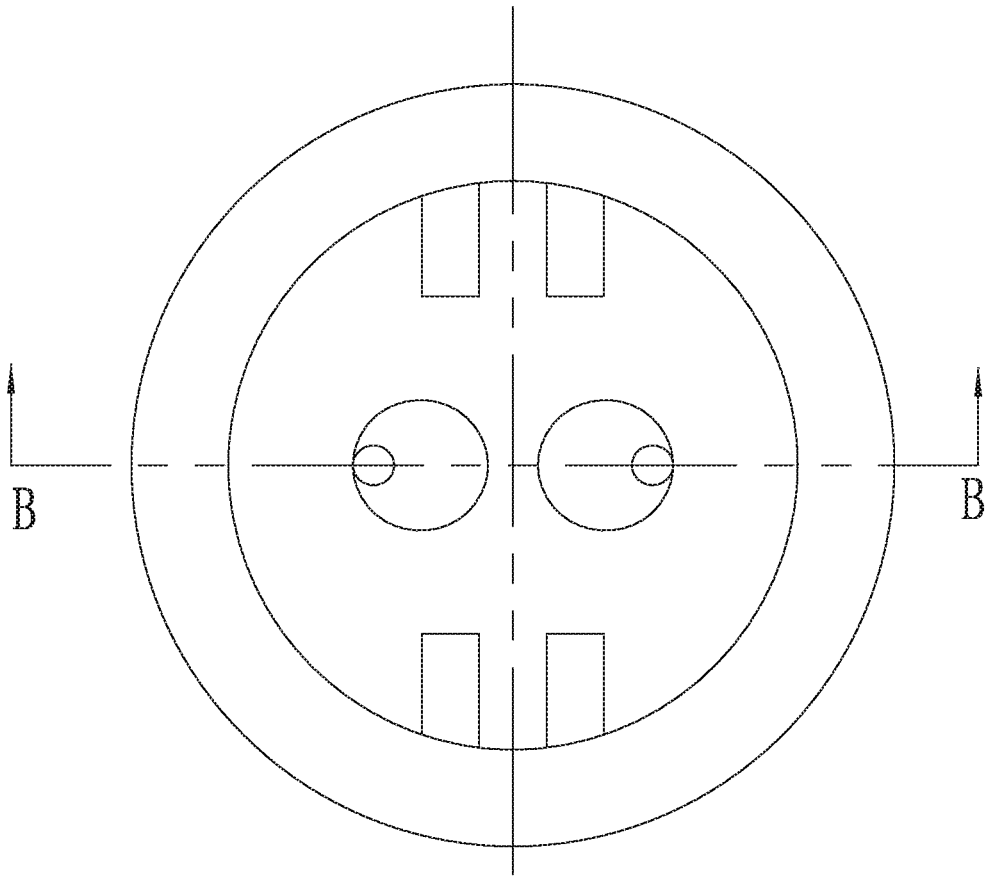
FIG. 4 illustrates a front view of the injector in Embodiment 1 of the present invention.
Figure 5:
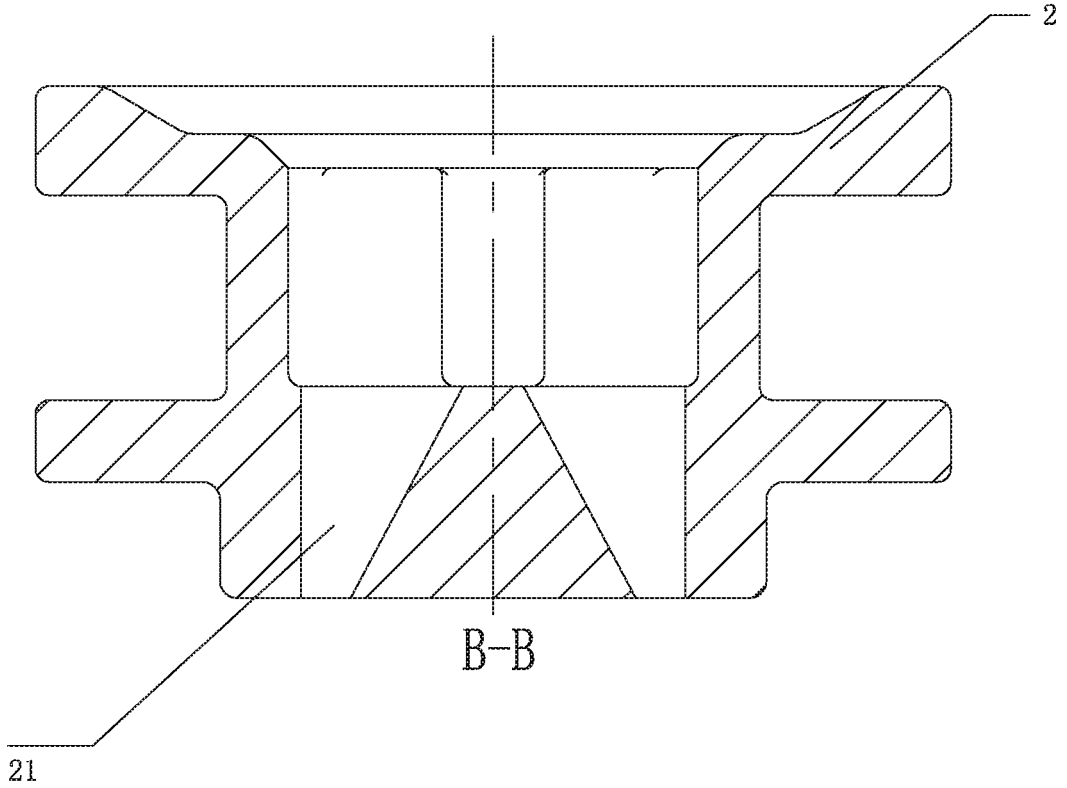
FIG. 5 illustrates a cross-sectional view of the injector in Embodiment 1 of the present invention.
Figure 6:
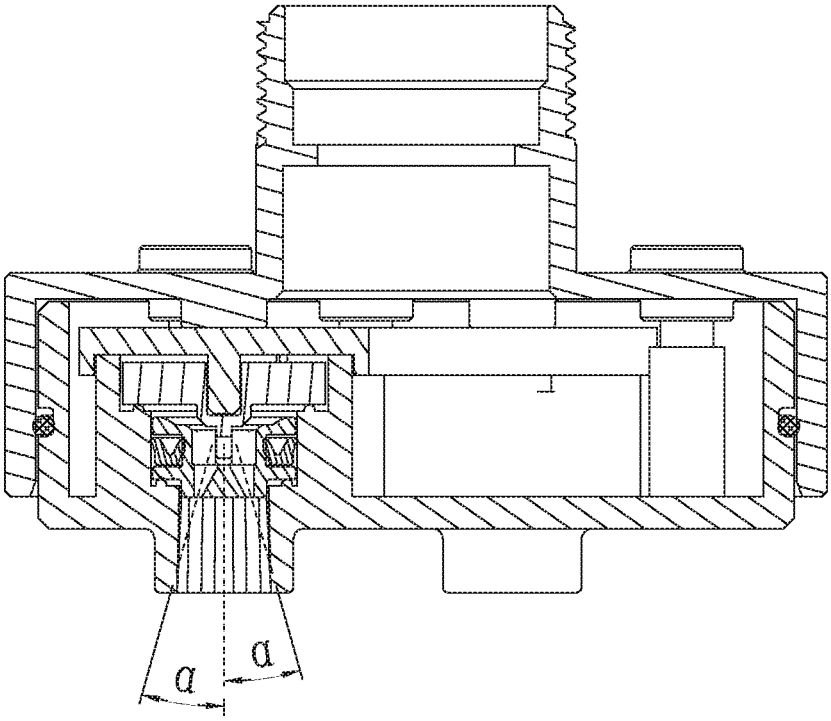
FIG. 6 illustrates a cross-sectional view of the water outlet device in Embodiment 1 of the present invention.
Figure 7:
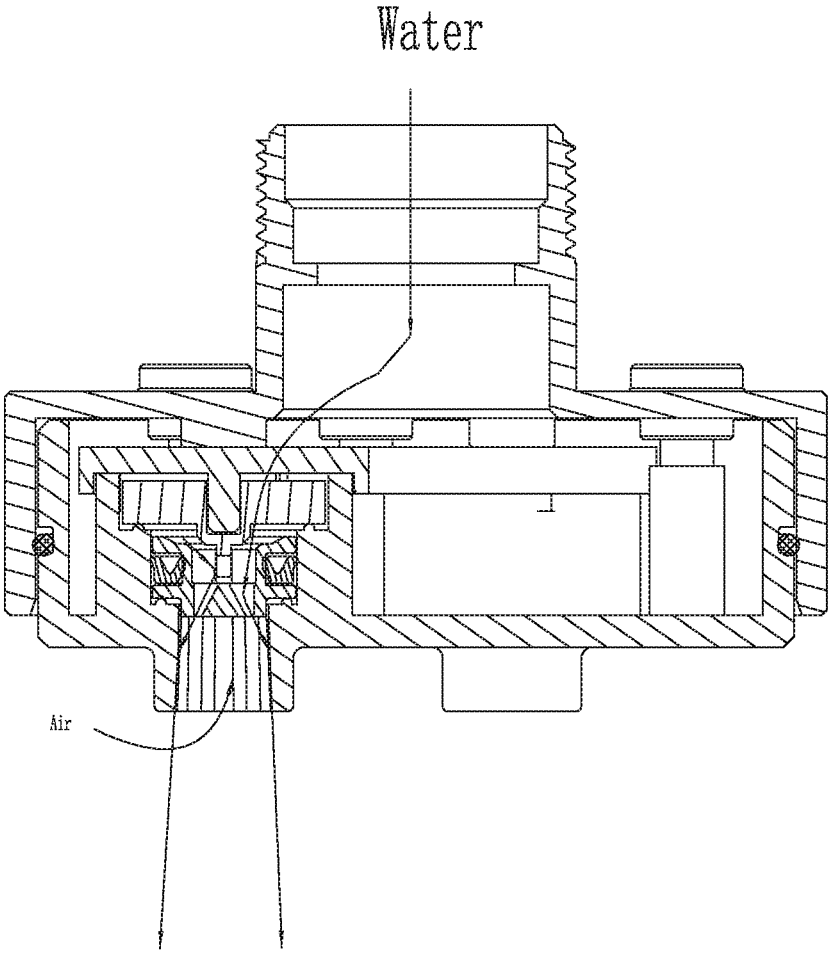
FIG. 7 illustrates a schematic view of the water flow passage according to the water outlet device in Embodiment 1 of the present invention.

The present invention will be further described below with the combination of the accompanying drawings together with the embodiments.

Embodiment 1

Referring to FIGS. 1-7, the water outlet device comprises at least one rotatable driving member 1, at least one injector 2, and a main body 3 with a plurality of water outflow passages 31.

The main body 3 comprises at least one accommodating cavity 32. Each of the at least one accommodating cavity 32 is connected to a corresponding one of the plurality of water outflow passages 31, and each of the at least one accommodating cavity 32 is disposed above the corresponding one of plurality of water outflow passages 31. Each of the at least one rotatable driving member 1 and a corresponding one of the at least one injector 2 are respectively disposed in a corresponding one of the at least one accommodating cavity 32. Each of the at least one rotatable driving member 1 is driven to rotate by water flow, and each of the at least one injector 2 is driven to rotate in the corresponding one of the at least one accommodating cavity 32 by a corresponding one of the at least one rotatable driving member 1.

Each of the at least one injector 2 comprises at least one injection hole 21. Each of the at least one injection hole 21 is connected to the corresponding one of the plurality of water outflow passages 31. A water outflow direction of the at least one injection hole 21 and an axial direction of a corresponding one of the plurality of water outflow passages 31 forms an angle a. As the angle a becomes larger, a collision between water flowing out from the at least one injection hole 21 and inner sidewalls of the corresponding one of the plurality of water outflow passages 31 becomes more obvious. As the collision becomes more obvious, an atomization effect of a water spray pattern of the water flow becomes better and an energy loss of the water flow becomes larger, so that an impact force of the water flow decreases. As the collision becomes less obvious, the atomization effect of the water spray pattern of the water flow becomes weaker and an energy loss of the water flow becomes smaller, so that the impact force of the water flow increases. Therefore, it is possible to select an appropriate angle of the angle a that is suitable for different types of showers.

The inner sidewalls of the plurality of water outflow passages 31 are tapered, and the tapered inner sidewalls can be designed in two ways. As a radial dimension of each of the inner sidewalls of the plurality of water outflow passages 31 gradually becomes smaller in a direction of the water flow (e.g., an upper portion of the inner sidewalls is larger than a lower portion of the inner sidewalls in the direction of the water flow), the water spray pattern of the water flow has a more concentrated range and a stronger impact force. As the radial dimension of each of the inner sidewalls of the plurality of water outflow passages 31 gradually becomes larger in the direction of the water flow (e.g., a lower portion of the inner sidewalls is larger than an upper portion of the inner sidewalls in the direction of the water flow), the water spray pattern of the water flow has a larger range and a weaker impact force. In this embodiment, due to the tapered inner sidewalls, the radial dimension of each of the inner sidewalls of the plurality of water outflow passages 31 in the direction of the water flow gradually becomes larger. In practical use, it is also possible to find a balance between the range and the impact force suitable for different types of showers.

Further, when water flows out from the plurality of water outflow passages 31, external air also enters the plurality of water outflow passages 31 to be mixed with the water, so that the water flow further forms an aerated water flow.

Specifically, in order to achieve the angle a between the water outflow direction of the at least one injection hole 21 and the axial direction of the plurality of water outflow passages 31, in a cross-sectional view of each of the at least one injection hole 21 in the axial direction of the corresponding one of the plurality of water outflow passages 31, a first sidewall of each of the at least one injection hole 21 adjacent to a central axis of the injector 2 is sloped relative to the axial direction of the corresponding one of the plurality of water outflow passages, a second sidewall of each of the at least one injection hole 21 away from the central axis of the injector 2 is parallel to the axial direction of the corresponding one of the plurality of water outflow passages 31.

Each of the inner sidewalls of the plurality of water outflow passages 31 is disposed with a plurality of regulating strips 311. The plurality of regulating strips 311 extend in a length direction of each of the inner sidewalls (i.e., extend in the direction of the water flow), and the plurality of regulating strips 311 are disposed along a circumference of each of the inner sidewalls at intervals. The regulating strips 311 help to regulate the water flow in the plurality of water outflow passages 31 to mitigate turbulence, so that the water spray pattern can achieve a desired effect.

In this embodiment, the rotatable driving member 1 is an impeller, the main body 3 comprises at least one water oblique inlet on a first side away from the plurality of water outflow passages 31, and water flowing from the at least one water oblique inlet impacts the impeller and drives the impeller to rotate.

To link the impeller and the injector 2 so that the impeller can drive the injector 2, a first side of the impeller adjacent to the injector 2 extends outwardly to form an insert bar in a direction of a central axis of the impeller, and the injector 2 comprises an insert hole for coupling with the insert bar.

In the aforementioned water outlet device, the water spray pattern is atomized water with relative obvious atomized effect, low impact force, and a larger dispersed range.

Embodiment 2

Figure 8:
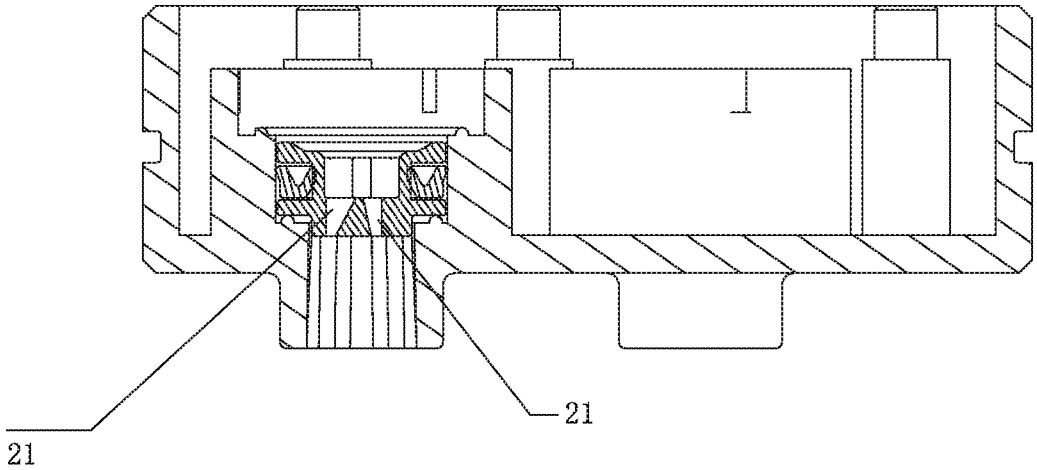
FIG. 8 illustrates a cross-sectional view of the water outlet device in Embodiment 2 of the present invention.
Figure 9:
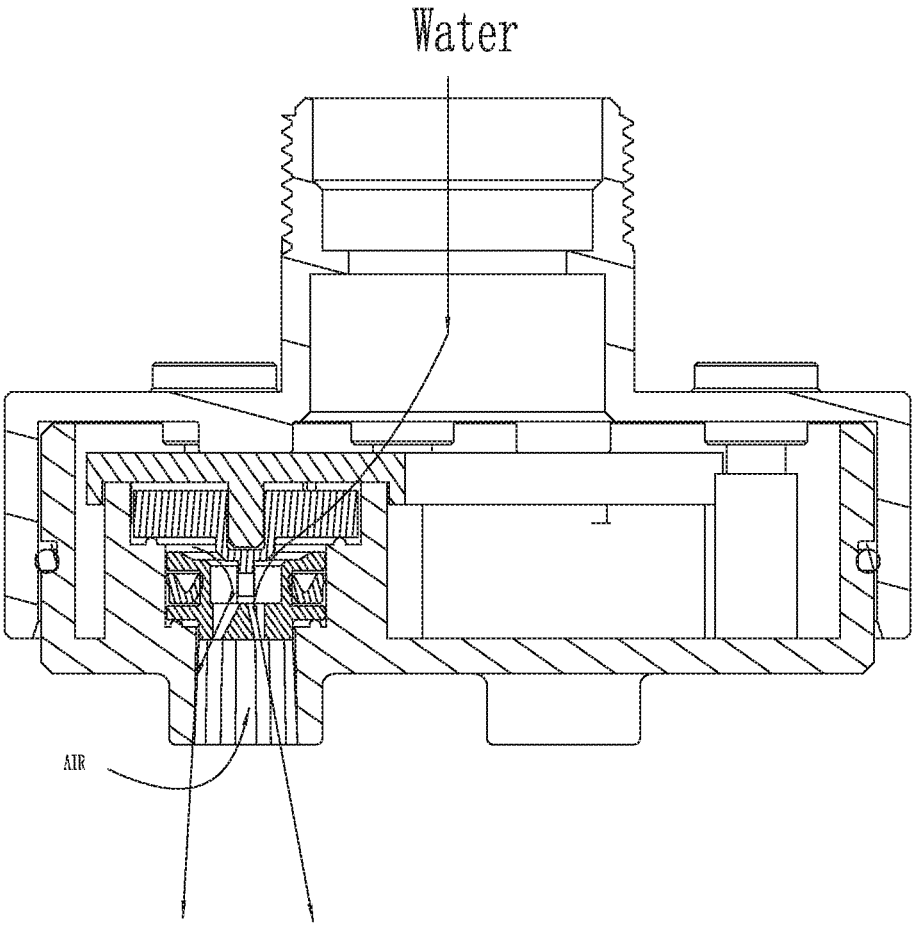
FIG. 9 illustrates a schematic view of the water flow passage according to the water outlet device in Embodiment 2 of the present invention.

Referring to FIG. 8 and FIG. 9, the difference between this embodiment and Embodiment 1 is that, at a surface of the at least one injector 2 facing the corresponding one of the plurality of water outflow passages 31, a center of a first injection hole 21 (to the right in FIG. 8 and FIG. 9) is spaced a first distance from a central axis of the injector 2 and a center of a second injection hole 21 (to the left in FIG. 8 and FIG. 9) is spaced a second distance from the central axis of the injector 2 and the angle a between a water outflow direction of the first injection hole 21 and the axial direction of the corresponding one of the plurality of water outflow passages 31 is different than the angle a between a water outflow direction of the second injection hole 21 and the axial direction of the corresponding one of the plurality of water outflow passages 31.

This embodiment comprises injection holes at two different radial positions relative to the central axis. The angle a between the water outflow direction of the first injection hole 21 closer to the central axis and the axial direction of the corresponding one of the plurality of water outflow passages 31 is smaller than the angle a between the water outflow direction of the second injection hole 21 further away from the central axis and the axial direction of the corresponding one of the plurality of water outflow passages 31.

Therefore, the water from the first injection hole 21 has a strong impact force and a relatively weak atomization effect, so that the water outlet device of this embodiment achieves a mixed water outflow effect of two water flows. In the two water flows, if one of the two water flows is to be strengthened, additional injection holes 21 can be added that are approximately the same radial distance away from the central axis of the injector 2 as the first injection hole 21 or as the second injection hole 21.

Embodiment 3

Figure 10:
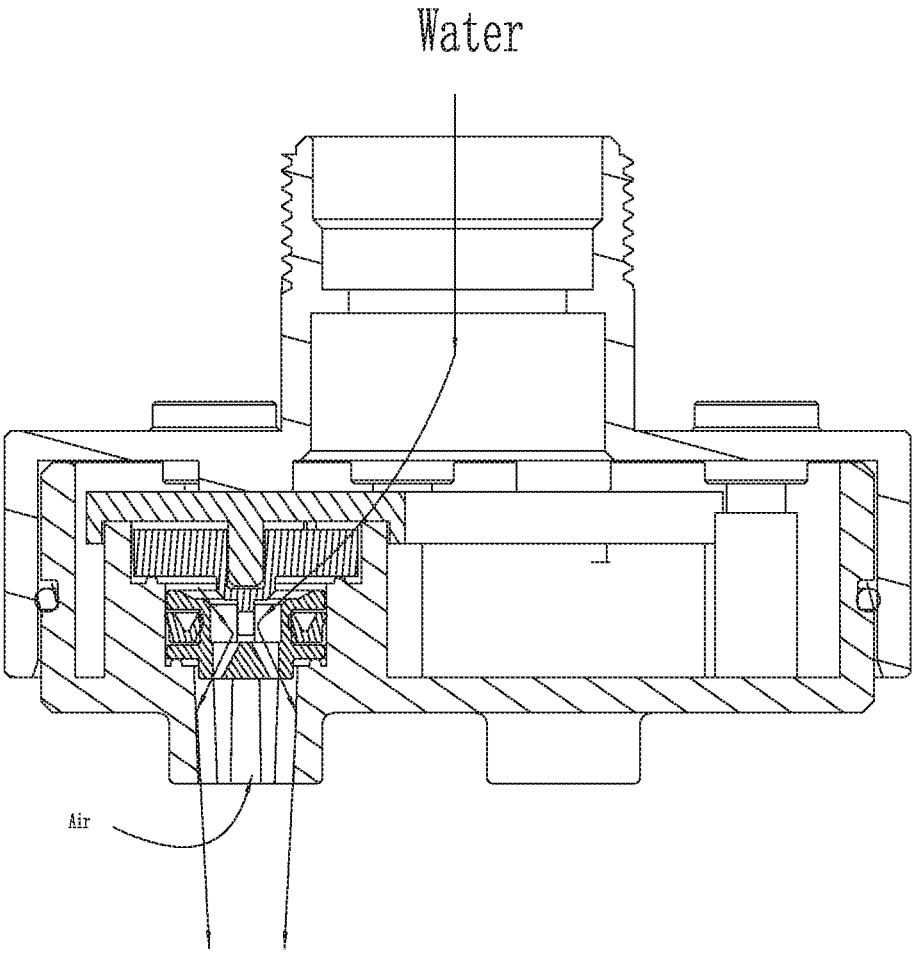
FIG. 10 illustrates a schematic view of the water flow passage according to the water outlet device in Embodiment 3 of the present invention.

Referring to FIG. 10, the difference between this embodiment and Embodiment 1 is that the radial dimension of each of the inner sidewalls of the plurality of outflow passages 31 gradually becomes smaller in the direction of water flow, thereby forming a water spray pattern with more concentrated water flow and stronger impact force relative to the water flow and impact force of the water spray pattern formed by Embodiment 1.

Embodiment 4

Figure 11:
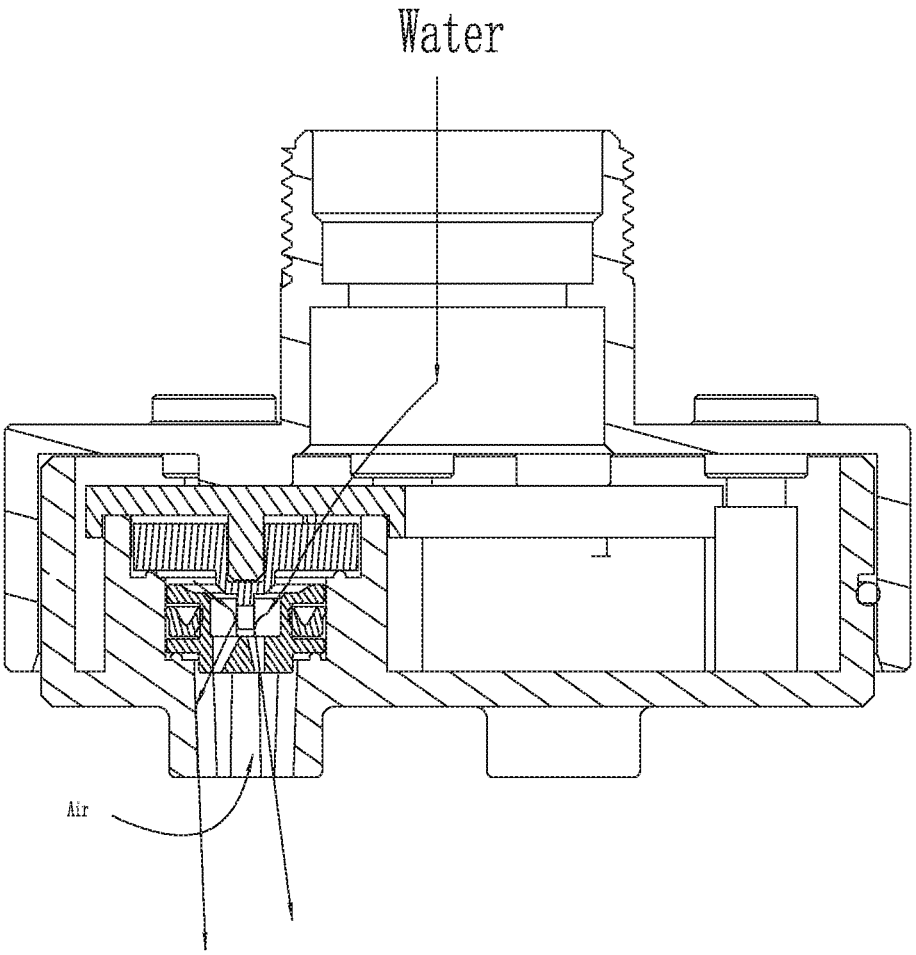
FIG. 11 illustrates a schematic view of the water flow passage according to the water outlet device in Embodiment 4 of the present invention.

Referring to FIG. 11, the difference between this embodiment and Embodiment 2 is that the radial dimension of each of the inner sidewalls of the plurality of outflow passages 31 gradually becomes smaller in the direction of water flow, thereby forming a water spray pattern with more concentrated water flow and stronger impact force relative to the water flow and impact force of the water spray pattern formed by Embodiment 2.

Therefore, the water outlet device provided by the present invention can freely adjust water spray patterns with various dispersed ranges, water outflow forms, and impact forces according to the adjustment of the angle a between the water outflow direction of the at least one injection hole 21 and the axial direction of the corresponding one of the plurality of water outflow passages 31, a radial spacing or distance between a central axis of the injector 2 and the at least one injection hole 21, and a taper β of the inner sidewalls of the plurality of water outflow passages 31, without making big adjustments to an overall structure of the water outlet device.

Embodiment 5

Figure 12:
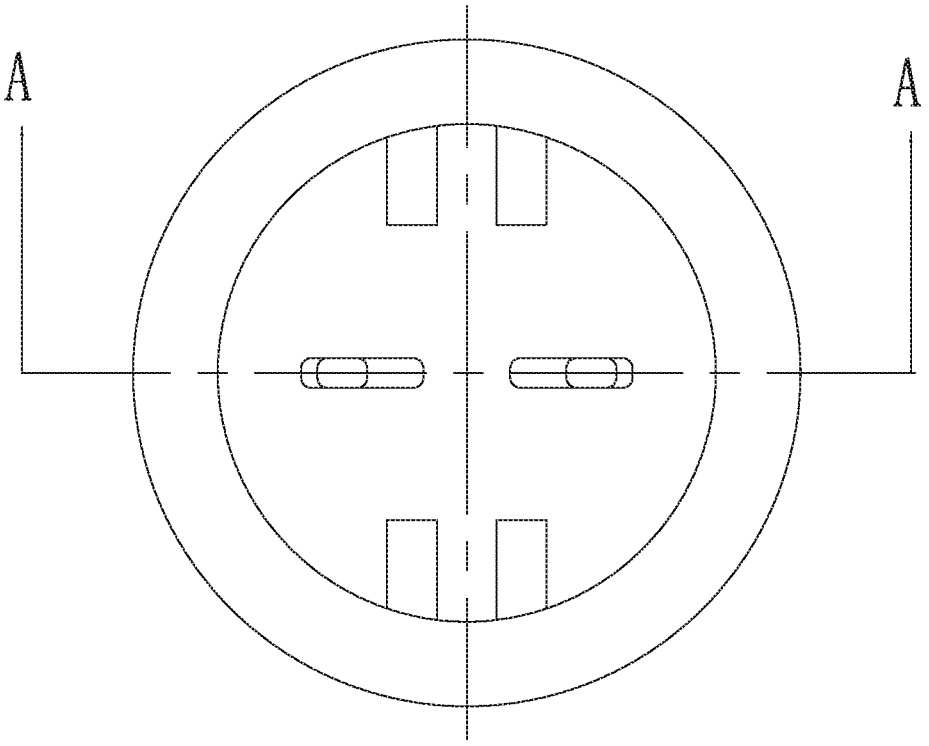
FIG. 12 illustrates a front view of the main body in Embodiment 5 of the present invention.
Figure 13:
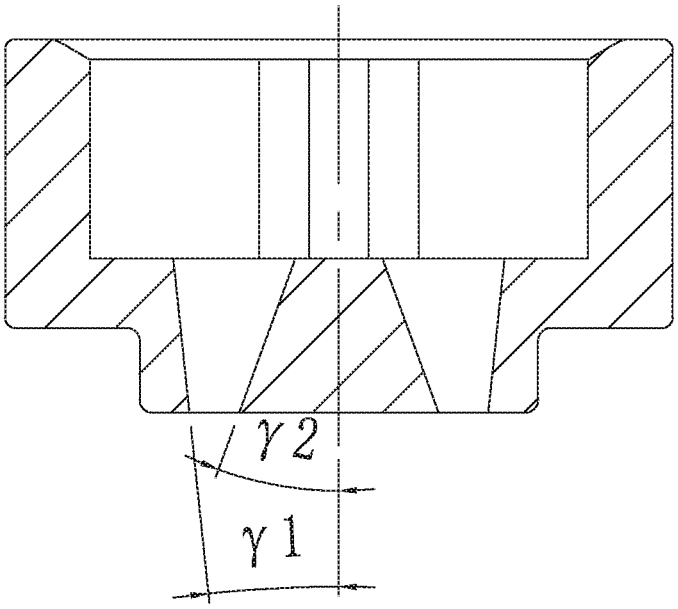
FIG. 13 illustrates a cross-sectional view of the main body in Embodiment 5 of the present invention.

Referring to FIGS. 12-13, the difference between this embodiment and Embodiment 1 is that in the cross-sectional view of each of the at least one injection hole 21 in the axial direction of the corresponding one of the plurality of water outflow passages 31, a first sidewall of each of the at least one injection hole 21 adjacent to a central axis of the injector 2 is sloped relative to the axial direction of the corresponding one of the plurality of water outflow passages 31, a second sidewall of each of the at least one injection hole 21 away from the central axis of the injector 2 is also sloped relative to the axial direction of the corresponding one of the plurality of water outflow passages 31, and an angle γ1 between the second sidewall and the axial direction of the plurality of water outflow passages 31 is smaller than an angle γ2 between the first sidewall and the axial direction of the plurality of water outflow passages 31, so that this embodiment can achieve an effect similar to that of Embodiment 1, in which the second sidewall of each of the at least one injection hole 21 is parallel to the axial direction of the plurality of water outflow passages 31.

The above description is only a preferred embodiment of the present disclosure, and the scope of the present disclosure is not limited in this embodiment. That is, equivalent changes and modifications made in the scope of the disclosure and the specification contents should remain within the scope of the present disclosure.

What is claimed is:

1. A water outlet device, comprising:

at least one rotatable driving member;

at least one injector; and a main body with a plurality of water outflow passages, wherein:

the main body comprises at least one accommodating cavity, each of the at least one accommodating cavity is connected to a corresponding one of the plurality of water outflow passages, each of the at least one accommodating cavity is disposed above the corresponding one of the plurality of water outflow passages, each of the at least one rotatable driving member and a corresponding one of the at least one injector are disposed in a corresponding one of the at least one accommodating cavity, each of the at least one rotatable driving member is driven to rotate by water flow, each of the at least one rotatable driving member drives the corresponding one of the at least one injector to rotate in the corresponding one of the at least one accommodating cavity, each of the at least one injector comprises at least one injection hole, the at least one injection hole is connected to the corresponding one of the plurality of water outflow passages, a water outflow direction of the at least one injection hole and an axial direction of the corresponding one of the plurality of water outflow passages forms an angle, a collision between water flowing out from the at least one injection hole and inner sidewalls of the corresponding one of the plurality of water outflow passages changes as a function of the angle, and the inner sidewalls of the plurality of water outflow passages are tapered.

2. The water outlet device according to claim 1, wherein, in a cross-sectional view of each of the at least one injection hole in the axial direction of the corresponding one of the plurality of water outflow passages:

a first sidewall of each of the at least one injection hole adjacent to a central axis of the injector is sloped relative to the axial direction of the corresponding one of the plurality of water outflow passages, and a second sidewall of each of the at least one injection hole away from the central axis of the injector is parallel to the axial direction of the plurality of water outflow passages.

3. The water outlet device according to claim 2, wherein:

a radial dimension of each of the inner sidewalls of the plurality of water outflow passages gradually becomes smaller in a direction of the water flow.

4. The water outlet device according to claim 2, wherein:

a radial dimension of each of the inner sidewalls of the plurality of water outflow passages gradually becomes larger in a direction of the water flow.

5. The water outlet device according to claim 1, wherein:

each of the at least one injector comprises at least two injection holes, at a surface of the at least one injector facing the corresponding one of the plurality of water outflow passages, a center of a first injection hole of the at least two injection holes is spaced a first distance from a central axis of the injector and a center of a second injection hole of the at least two injection holes is spaced a second distance from the central axis of the injector, and the second distance is greater than the first distance.

6. The water outlet device according to claim 5, wherein:

an angle between a water outflow direction of the first injection hole and the axial direction of the corresponding one of the plurality of water outflow passages is different than an angle between a water outflow direction of the second injection hole and the axial direction of the corresponding one of the plurality of water outflow passages.

7. The water outlet device according to claim 6, wherein:

the angle between the water outflow direction of the first injection hole and the axial direction of the corresponding one of the plurality of water outflow passages is smaller than the angle between the water outflow direction of the second injection hole and the axial direction of the corresponding one of the plurality of water outflow passages.

8. The water outlet device according to claim 5, wherein:

a number of injection holes of the at least one injector having centers spaced the first distance from the central axis of the injector is different than a number of injection holes of the at least one injection having centers spaced the second distance from the central axis of the injector.

9. The water outlet device according to claim 1, wherein:

a radial dimension of each of the inner sidewalls of the plurality of water outflow passages gradually becomes smaller in a direction of the water flow.

10. The water outlet device according to claim 9, wherein:

each of the inner sidewalls of the plurality of water outflow passages is disposed with a plurality of regulating strips, the plurality of regulating strips extend in the direction of the water flow, and the plurality of regulating strips are disposed along a circumference of each of the inner sidewalls at intervals.

11. The water outlet device according to claim 10, wherein:

the rotatable driving member is an impeller, the main body comprises at least one water oblique inlet on a first side away from the plurality of water outflow passages, and water flowing from the at least one water oblique inlet impacts the impeller and drives the impeller to rotate.

12. The water outlet device according to claim 11, wherein:

a first side of the impeller adjacent to the injector extends outwardly to form an insert bar in a direction of a central axis of the impeller, and the injector comprises an insert hole for coupling with the insert bar.

13. The water outlet device according to claim 1, wherein, in a cross-sectional view of each of the at least one injection hole in the axial direction of the corresponding one of the plurality of water outflow passages:

a first sidewall of each of the at least one injection hole adjacent to a central axis of the injector is sloped relative to the axial direction of the corresponding one of the plurality of water outflow passages, a second sidewall of each of the at least one injection hole away from the central axis of the injector is sloped relative to the axial direction of the corresponding one of the plurality of water outflow passages, and a first angle between the second sidewall and the axial direction of the corresponding one of the plurality of water outflow passages is smaller than a second angle between the first sidewall and the axial direction of the corresponding one of the plurality of water outflow passages.

14. The water outlet device according to claim 1, wherein:

a radial dimension of each of the inner sidewalls of the plurality of water outflow passages gradually becomes larger in a direction of the water flow.

* * * * *